US005666619A

United States Patent [19]

Hart et al.

[11] Patent Number: 5,666,619

[45] Date of Patent: Sep. 9, 1997

[54] ELECTRODE WIRE SUPPORT FOR SCAVENGELESS DEVELOPMENT

[75] Inventors: Steven C. Hart; Thomas J. Behe, both of Webster; Mark J. Hirsch, Fairport; Alexander J. Fioravanti, Penfield; Thomas W. Pike, Rochester, all of N.Y.

[73] Assignee: Xerox Corporation, Stamford, Conn.

[21] Appl. No.: 568,108

[22] Filed: Dec. 6, 1995

[51] Int. Cl.[6] ..... G03G 15/08

[52] U.S. Cl. ..... 399/266

[58] Field of Search ..... 355/247, 261–263; 118/647–651, 654; 399/266, 290, 291

[56] References Cited

U.S. PATENT DOCUMENTS

| | | | |
|---|---|---|---|
| 4,868,600 | 9/1989 | Hays et al. | 355/259 |
| 5,124,749 | 6/1992 | Bares | 355/202 |
| 5,153,647 | 10/1992 | Barker | 355/245 |
| 5,153,648 | 10/1992 | Lioy et al. | 355/247 |
| 5,270,483 | 12/1993 | Inoue et al. | 118/647 |
| 5,300,992 | 4/1994 | Wayman et al. | 355/261 |
| 5,324,941 | 6/1994 | Gross et al. | 250/324 |
| 5,338,893 | 8/1994 | Edmunds et al. | 118/647 |
| 5,422,709 | 6/1995 | Minagawa et al. | 355/247 |
| 5,424,540 | 6/1995 | Garcia et al. | 250/326 |

*Primary Examiner*—Robert Beatty

[57] ABSTRACT

A novel wire module support structure for controlling the spacing and edge wire angle of an electrode wire relative to a donor roll in a scavengeless development process is disclosed. A stationary wire support is arc shaped with a rounded edge and is located in close proximity to the donor roll end. This spatial relationship between the donor roll end and the wire support surface optimizes the donor roll surface to wire relationship. The wire support surface may be at a greater or lesser radius than the the donor roll surface. When the wire support surface is located at a larger radius than the donor roll surface, a clamp assembly is used to control the height of the wires with respect to the donor roll surface.

16 Claims, 8 Drawing Sheets

ELECTRODE WIRE SUPPORT FOR SCAVENGELESS DEVELOPMENT

Related patent applications entitled "Electrode Wire Positioning for Scavengeless Development" (D/95201), U.S. Ser. No. 08/568,605 "Electrode Wire Tensioning for Scavengeless Development" (D/95202) U.S. Ser. No. 08/568,106 and "Electrode Wire Twisted Loop Mounting for Scavengeless Development" (D/95204) U.S. Ser. No. 08/568,107 are being filed on the same date as this patent application.

This invention relates generally to developer apparatus for electrophotographic printing. More specifically, the invention relates to controlling the spacing and edge angle of an electrode wire relative to a donor roll in a scavengeless development system.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "transport" roll. The transport roll is typically in the form of a cylindrical sleeve rotating around a fixed assembly of permanent magnets. The carrier beads form chains extending from the surface of the transport roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a transport roll. In the development zone adjacent the electrostatic latent image on a photoreceptor, the electrostatic charge on the photoreceptor will cause the toner particles to be pulled from the developer to the photoreceptor. (As used in the claims herein, the phrase "developer material" shall be construed to mean either single-component or two-component developer material, or a portion thereof, such as the toner separated from the two-component developer material on a magnetic brush.)

An important variation to the general principle of development is the concept of "scavengeless" development. The purpose and function of scavengeless development are described more fully in, for example, U.S. Pat. No. 4,868,600. In a scavengeless development system, toner is made available to the photoreceptor by means of AC electric fields supplied by electrode structures, commonly in the form of wires extending across the photoreceptor, positioned within the nip between a donor roll and photoreceptor. The spacing between the wires and the donor roll is on the order of the thickness of the toner or less, under certain operating conditions the wires may be in contact with the donor roll. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical "hybrid" scavengeless development apparatus includes, within a developer housing, a transport roll, a donor roll, and an electrode structure. The transport roll operates in a manner similar to a development roll in a conventional development system, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

The following disclosures may be relevant to various aspects of the present invention:

U.S. Pat. No. 4,868,600

Patentee: Hays et al.

Issued: Sep. 19, 1989

U.S. Pat. No. 5,124,749

Patentee: Bares

Issued Jun. 23, 1992

U.S. Pat. No. 5,300,992

Patentee: Wayman et al.

Issued: Apr. 5, 1994

U.S. Pat. No. 5,153,648

Patentee: Lioy et al.

Issued: Oct. 6, 1992

U.S. Pat. No. 5,338,893

Patentee: Edmunds et al.

Issued: Aug. 16, 1994

U.S. Pat. No. 5,153,647

Patentee: Barker et al.

Issued Oct. 6, 1992

The relevant portions of the foregoing disclosures may be briefly summarized as follows:

U.S. Pat. No. 4,868,600 describes a scavengeless development system in which toner is detached from a donor roll by AC electric fields applied to electrode structures which generate a controlled powder cloud of toner for the development of a latent image. The electrode structure is comprised of one or more thin wires which are placed in close proximity to the toned donor within the gap between the toned donor and the latent image. The wires are spaced from the donor structure by the thickness of the toner on the donor structure. The extremities of the wires are supported by the tops of end blocks on both ends of the donor roll which also support the donor roll for rotation. The wire extremities are attached so that they are slightly below a tangent to the donor with the toner layer surface.

U.S. Pat. No. 5,124,749 teaches a scavengeless development system in which the vibration of the electrode wires is dampened due to a unique wire support structure. The electrode wire is rigidly secured to a support with a wire anchor on one end and the donor roll at the other end. Damping the vibration of the electrode wire is accomplished by coating a portion of the electrode wire with a damping material. The damping material is applied to the wire and support between the anchor and the end of the support adjacent the donor roll.

U.S. Pat. No. 5,300,992 describes a method of supporting wire electrodes in a scavengeless development system. An off-axis wire mounting allows taut wires to make gentler contact with a rotating donor roll without tight tolerance requirements. The wires are made to "float", which means that there is no fixed anchor point for the wires.

U.S. Pat. No. 5,153,648 discloses a scavengeless development system with an electrode wire a support which contacts the wire in at least two points. The first support point is a lateral force pin which exerts a lateral or tangential force on the wire and is located close to the donor roll end. The second support is a horizontally mounted pin which exerts a vertical force on the wire and is placed under the wire at a location beyond that of the lateral force pin in the direction outwardly from the donor roll edge. An anchor point fixes the end of the wire beyond the horizontally mounted pin.

U.S. Pat. No. 5,338,893 teaches a scavengeless development apparatus with an electrode wire disposed between a donor roll and a latent image. The donor roll includes a section of increased diameter spaced away from the latent image and the electrode wire is disposed in sliding contact with the section of increased diameter to obtain a consistent spacing from the main length of the donor roll. A support structure with optional grooves, is located near the increased diameter ring area and supports the wire in the vertical direction after the wire passes over the increased diameter area. An anchor point is located beyond the support structure. A tensioning mechanism is provided so as to urge the electrode wires against the increased diameter area and the support structure.

U.S. Pat. No. 5,153,647 describes two different ways of positioning electrode wires in a development zone adjacent a photoconductive member in a scavengeless development system. One method of mounting the electrode wires is securing the ends of the electrode wires to an adjustable bow frame, which positions the electrode wires relative to the donor roll. The other method of mounting the electrode wires is fixing the wire ends to a rigid frame. One end of the wires is fixedly attached to the from and the other end may be adjustably attached to the frame.

All of the above patents are hereby incorporated by reference.

Hybrid scavangeless development utilizes very fine wires located in intimate contact with a rotating donor roll. In normal operation, the wire is electrically excited to cause the formation of a powder cloud in the photoreceptor/development nip. This excitation also attracts the wire to the donor roll. Thus in normal operation, a tensioned wire rides/rubs on a hard toner covered surface. In order for HSD systems to function properly, it is necessary to precisely locate the wires, to prevent the wire from vibrating like a musical instrument string, and to prevent the wire from wearing through at the donor roll ends. Precise control of the wire tension, wire to wire spacing, location of the wire array, and the spatial relationship between the wires and the donor roll ends has been demonstrated to prevent copy quality defects such as edge banding and strobing as well as to prevent wire wear at the donor roll ends and thus ensure maximal wire life.

SUMMARY

In accordance with one aspect of the present invention, there is provided an apparatus for developing a latent image recorded on a surface, including a housing storing a supply of developer material therein; a donor roll spaced from the surface and adapted to transport the developer material to a development zone adjacent the surface; a donor roll shaft on which the donor roll is mounted; a donor roll support, the donor roll shaft being rotatably mounted in the donor roll support; an electrode wire positioned in the space between the surface and the donor roll, the electrode wire being electrically biased to detach the developer material from the donor roll to form a cloud of developer material in the space between the electrode wire and the surface with the developer material developing the latent image; a wire module to which the ends of the wire are attached and tensioned; and support members for supporting the electrode wire along the length of the wire, the supporting members are located along the donor roll shaft between each end of the donor roll and the donor roll support and have a wire support surface which supports the wire in the vertical direction when the electrode wire is positioned in the space between the surface and said donor roll.

Pursuant to another aspect of the present invention, there is provided a wire support for supporting an electrode wire for use in a development system, including a top surface of the wire support adapted to longitudinally support the wire; and a front and back side of the wire support having an opening extending therethrough for mounting the wire support in the development system.

As explained above, HSD requires precise control of the relationship between the donor wires, supporting node for the donor wires, and the donor roll surface. The subject of this invention is to provide and locate the supporting node surface for the wire as an arc sectioned rounded edge support surface, an "R" bridge, which is mounted concentric to the donor roll shaft and is in close proximity to the donor roll end. This spatial relationship between the donor roll edge and the R bridge optimizes the donor roll surface to wire relationship at the roll end. The advantage of a generally arced shaped support surface is that it enables the use of a single design wire module and developer housing for development onto a photoreceptor of differing angles with respect to the horizontal. Such a feature is desired when designing a color copier/printer machine.

Other features of the present invention will become apparent as the following description proceeds and upon reference to the drawings, in which.

While the present invention will be described in connection with preferred embodiments thereof, it will be understood that it is not intended to limit the invention to these embodiment. On the contrary, it is intended to cover all alternatives, modifications, and equivalents as may be included within the spirit and scope of the invention as defined by the appended claims.

DETAILED DESCRIPTION

Figure 1:
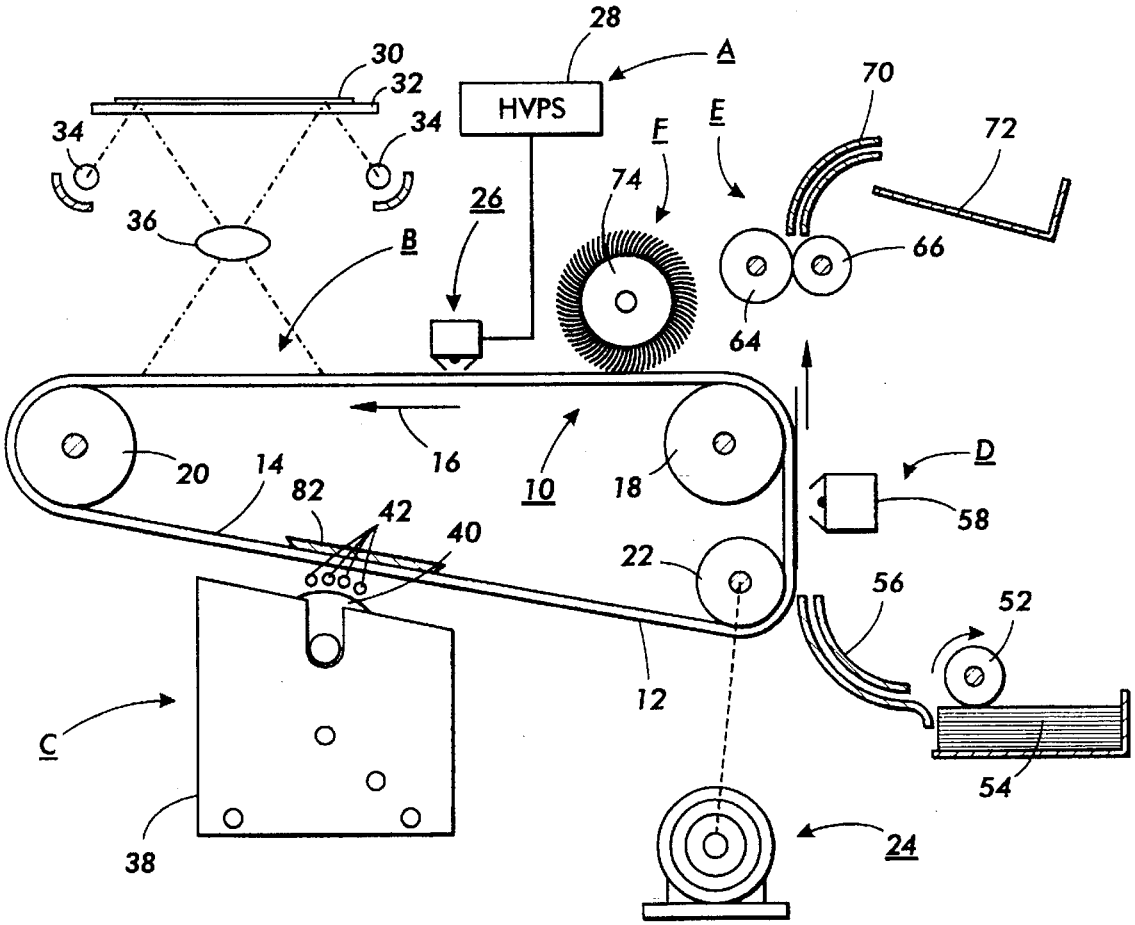
FIG. 1 is an elevational view of an electrophotgraphic printing apparatus in which the present invention may be embodied.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14 located on a flexible support member such as a Mylar™ belt. Preferably the surface 12 is made from a selenium alloy. The substrate 14 is preferably made from a conductive metal oxide which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system housed in housing 38 develops the latent image recorded on the photoconductive surface. Preferably, development system includes a donor roller 40 and electrode wires positioned in the gap between the donor roll and photoconductive belt. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in a chamber of the housing 38, which stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller.

After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
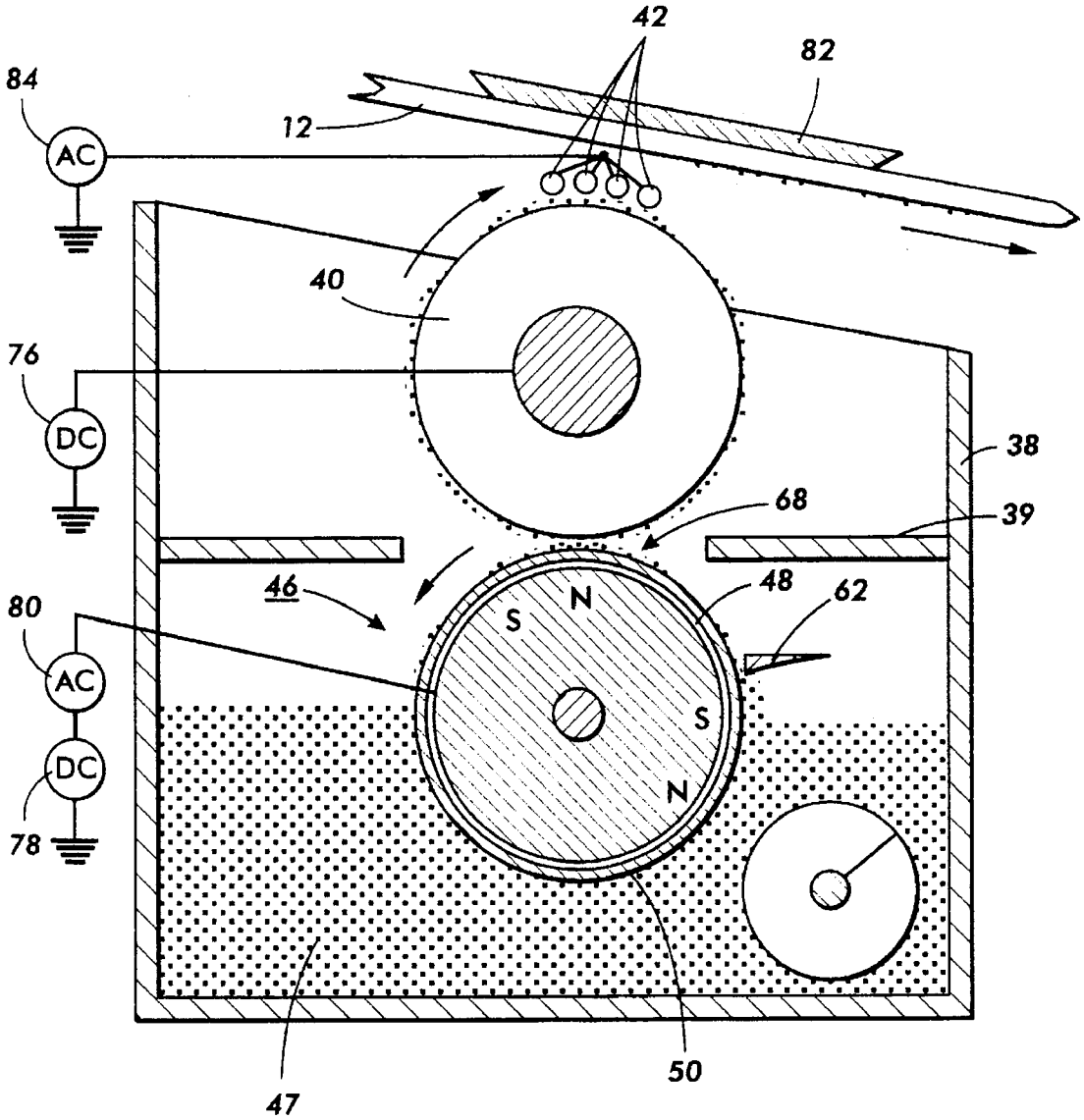
FIG. 2 is a simplified elevational view of a hybrid scavengeless development station.

Referring now to FIG. 2, there is shown a hybrid-scavengeless development system in greater detail. Housing 38 defines a chamber for storing a supply of developer material 47 therein. A housing shelf 39 separates the developer housing into two sections; one associated with the donor roll and the other associated with the transport roll 46. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeve 50 as it rotates to the nip 68 between transport roll 46 and donor roll 40. The donor roll is kept at a specific voltage, by a DC power supply 76, to attract a thin layer of toner particles from transport roll 46 in nip 68 to the surface of donor roll 40. Either the whole of the donor roll 40, or at least a peripheral layer thereof, is preferably of material which has low electrical conductivity. The material must be conductive enough to prevent any build-up of electric charge with time, and yet its conductivity must be low enough to form a blocking layer to prevent shorting or arcing of the magnetic brush to the donor roll.

Transport roll 46 is biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 2, or directly to the donor roll in series with supply 76.

Electrode wires 42 are disposed in the space between the belt 10 and donor roll 40. Four electrode wires are shown extending in a direction substantially parallel to the longitudinal axis of the donor roll 40. The electrode wires are made from of one or more thin (i.e. 25 to 125 micron diameter) steel, stainless steel or tungsten wires which are closely spaced from donor roll 40. The diameter of the wires shown in the figures is greatly exagerated compared to the real wires for illustrative purposes. The distance between the wires and the donor roll 40 is approximately the thickness of the toner layer formed on the donor roll 40, or less. The wires are self-spaced from the donor roller by the thickness of the toner on the donor roller. The wire is supported in close proximity to the ends of the donor roll. This support locates the wires such that the wire and donor roll end maintain a specific required angular relationship. An alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires At the region where the photoconductive belt 10 passes closest to donor roll 40, a stationary shoe 82 bears on the inner surface of the belt. The position of the shoe relative to the donor roll establishes the spacing between the donor roll and the belt. The spacing between the donor roll and photoconductive belt is preferably about 0.4 mm.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

Figure 3:
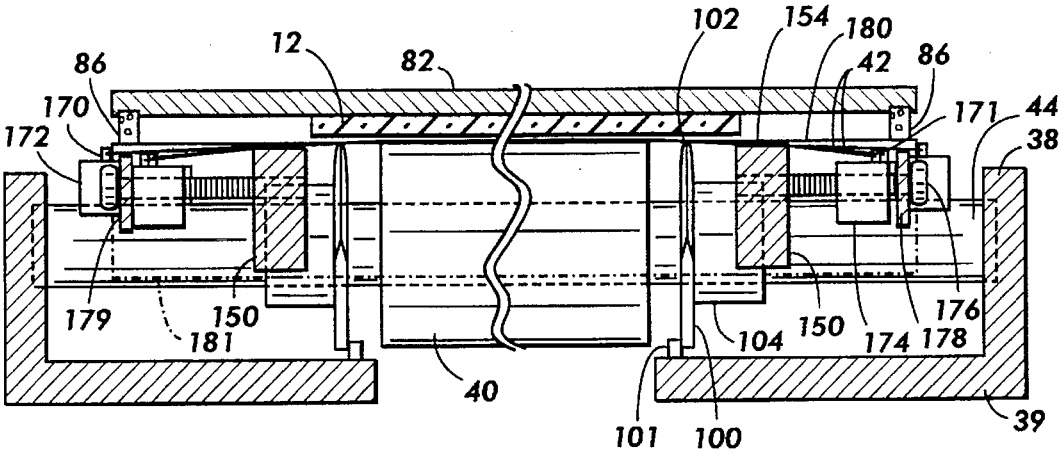
FIG. 3 is a side view of a novel wire module assembly.

FIG. 3 shows a novel wire module for supporting, tensioning and locating the wire electrodes 42 in a hybrid scavengeless development system. The following is a general description of the various components. As shown, there are four wires 42 in the wire module, however there may be fewer or more wires than four in any particular HSD system. For simplicity, only one of the wires and its supports will be referenced and discussed.

Donor roll 40 is supported by donor roll shaft 44. The donor roll shaft is rotatably supported by developer housing 38. A wire support 100, also referred to as an "R" bridge, is located in close proximity to the end of the donor roll and provides a narrow rounded and arc shaped stationary surface 102 for the electrode wire 42 to rest on. Affixed to the side of the R bridge is wire module mount 104 which enables mounting of the wire module to the R bridge and hence properly positions the wire module with respect to the donor roll. R bridge stops 101 are located on the developer housing shelf 39 on both ends of the donor roll so that the R bridge will be correctly positioned with respect to the donor roll ends.

A wire locating member 150, or "theta" bridge, attaches the wire module to the wire module mount 104. Preferably, the side supports of the theta bridge are configured to snap fit over the wire module mount for quick and easy attachment. Alternatively, the wire module may be affixed to the housing/module mounts using screws through the theta bridge. The theta bridge has grooves 154 on its upper surface to maintain the wire to wire spacing when the wires have been properly tensioned and positioned.

At the ends of the donor roll shaft is a wire tensioning system comprised of fixed wire anchor 170 and adjustable wire anchor 171, which are attached respectively to fixed wire anchor block 172 and adjustable wire anchor block 174.

An adjustment member 176 is held in place by cross bridge 178 at one end and the theta bridge 150 at the other end. The cross bridges 178 and 179 are fixed to the side beams 180 and 181 so as to provide a rigid rectangular structure for the wire module assembly. The cross bridge 178 and theta bridge 150 on each end of the wire module are stationary with respect to each other. Both have a clearance hole for the adjustment screw 176. The wire anchor block 174 has a threaded interior hole and is mounted onto the adjustment screw 176.

It is important to locate the wires accurately in the photoreceptor to donor roll nip. This can be accomplished by many means. For example, docking pads 86, as shown in FIG. 3 could be attached to the shoe 82, which would rotate the wire module assembly to the correct angular location. Alternatively a slot (not shown) maybe provided in the wire module mount 104 which would mate with a similar projecting feature in the theta bridge 150 so as to provide the correct angular location of the assembly. Thus, the angular location of the wire module could be predetermined and fixed with respect to the donor roll. This would allow the wire module assembly to be snap mounted onto the developer housing and utilized at different predetermined angular locations.

Figure 4:
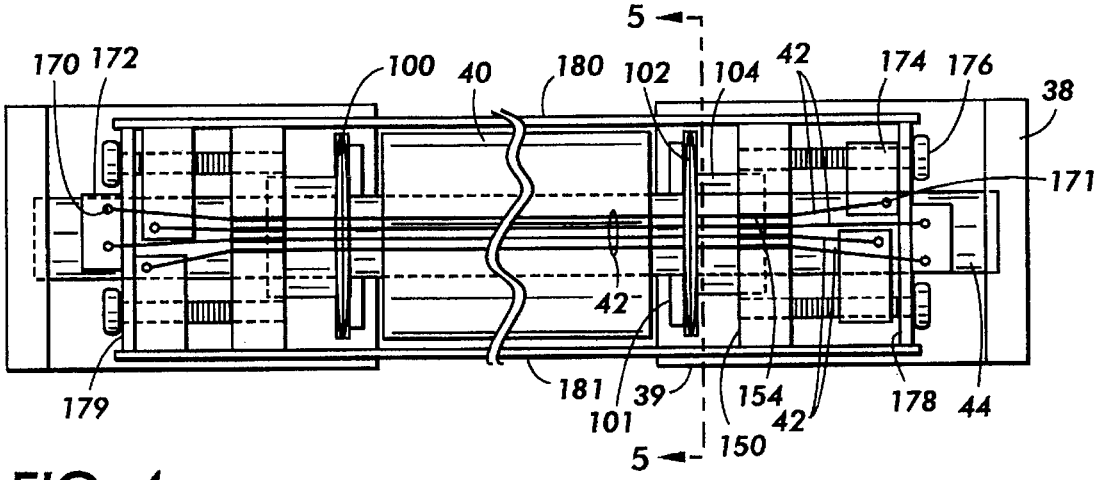
FIG. 4 is a plan view of the novel wire module assembly.

FIG. 4 provides a top view of the wire module, which will be used to discuss the adjustment and placement of the wire module assembly. The R bridge wire locating surface 102 and wire module mount 104 are properly positioned near the end of the donor roll 40 along the donor roll shaft 44. In a separate operation, the wire is attached to wire anchors 170 and 171 and the adjustment member 176 is turned to move the adjustable wire anchor block in such a way that the wire is properly tensioned. As the wire becomes taut, it is securely located in a groove 154 on the theta bridge 150 wire support surface. The entire wire module assembly is then mounted to the developer housing by mounting the theta bridge onto the wire module mount 104.

Figure 5:
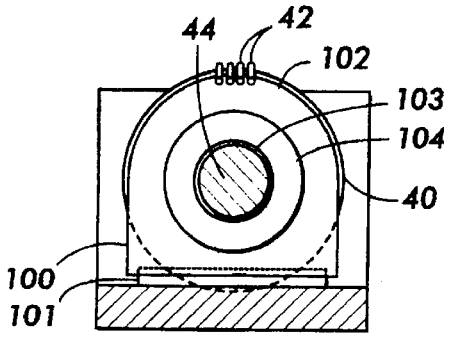
FIG. 5 is an end view of the novel wire support and wire module mount taken along line 5/5 of FIG. 4.

FIG. 5 is an end view of the R bridge/donor roll along section line 5/5 of FIG. 4. This view shows the R bridge 100 mounted on donor roll shaft 44. The R bridge is designed to provide a narrow stationary surface in close proximity to the end of the donor roll. Electrode wires 42 are supported by the R bridge surface 102. Affixed to the side of the R bridge is wire module mount 104 which enables a snap mount of the theta bridge and the wire module onto the R bridge. The R bridge 100 and wire module mount 104 can be positioned by sliding along the donor roll shaft to the desired location next to the donor roll ends. There is a clearance channel 103 between the R bridge and shaft as shown.

Figure 6:
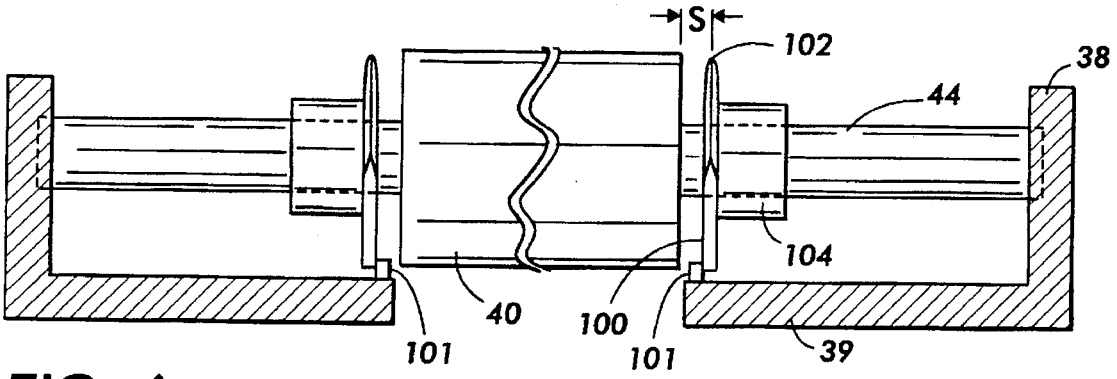
FIG. 6 is a side view of the novel wire support and wire module mount.

FIG. 6 is a view of the donor roll/R bridge assembly shown in FIG. 4 with the wire module assembly removed. The spacing S of the R bridge from the end of the donor roll and the wire height setting surface 102 of the R bridge with respect to the donor roll are critical parameters in that they determine the wire edge angle. The R bridge should be located as close as possible to the end of the donor roll in order to prevent strobing effects; the height of the wires above the donor roll is critical for proper development. The R bridge surface 102 is arcuate in shape with rounded edges and positioned so that it is concentric with the donor roll 40. The R bridge surface 102 is at approximately the same radius as the donor roll itself. The concentric relationship also enables setting the donor roll to wire spatial relationship over a wide range of angular locations with respect to the donor roll cylindrical axis within the developer housing, which is needed for multiple developer housing machines. This decision further enables the use of common hardware for multiple housing usage in products, which is of significant advantage.

Wire module mount 104 is affixed to the side of the R bridge and rotatably mounted with the R bridge to the donor roll shaft 44. The wire module mount 104 is preferably cylindrical in shape and is located concentrically with the donor roll as shown. R bridge stops 101 on the developer housing shelf 39 ensure that the R bridge is properly located.

Figure 7:
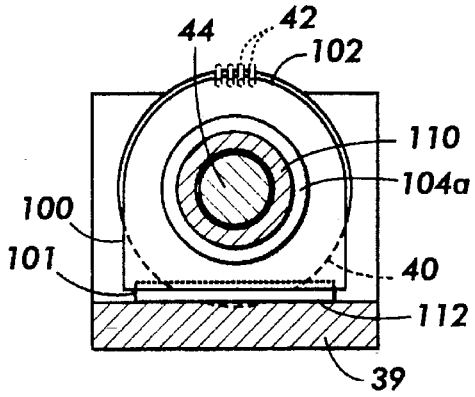
FIG. 7 is an end view of a particular embodiment of the wire support and wire module mount.

FIG. 7 is an end view of alternate bearing mount embodiment of the R bridge/wire module mount assembly with the wire module omitted for clarity. This implementation is very similar to that of FIG. 5, except that the R bridge 100 is mounted on a bushing or bearing sleeve 110 which allows free rotation of the of the donor roll shaft and donor roll with respect to the R bridge/wire module mount assembly. The R bridge 100 and wire module mount **104*a* are properly positioned along the donor roll shaft 44 by either e rings attached to the shaft or features affixed to the developer wall (not shown). Opposite the curved wire location surface 102 of the R bridge is a flat surface 112 which is adjacent the developer housing shelf 39**. The flat surface and its position next to the developer housing wall prevents rotation of the R bridge during operation of the development system.

Figure 8:
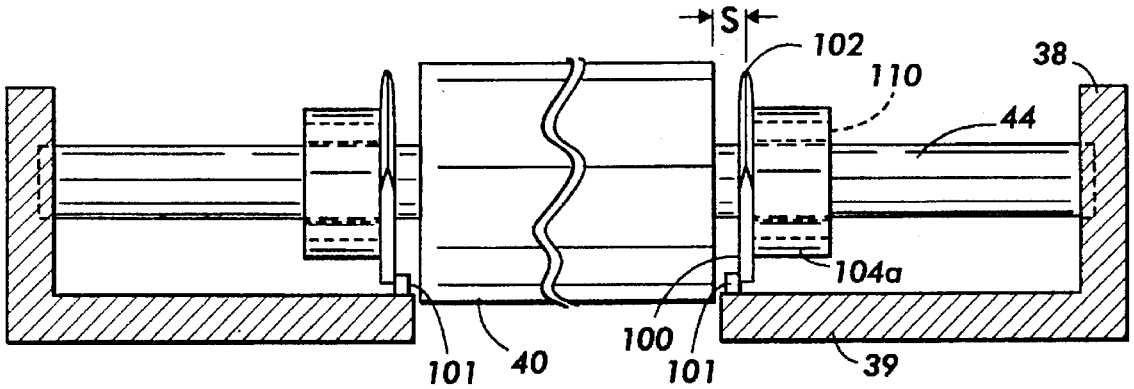
FIG. 8 is a side view of the wire support and wire module mount shown in FIG. 7.

FIG. 8 is a sectional view of the R bridge/wire module mount assembly of FIG. 7. The wire location surface of the R bridge 102 is located a space S from the end of the donor roll.

Figure 9:
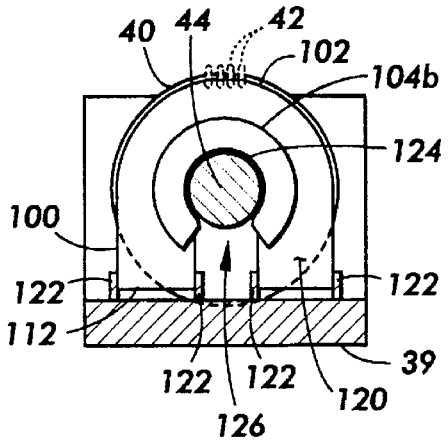
FIG. 9 is an end view of another embodiment of the wire support and wire module mount.

FIG. 9 depicts a fixed end mount embodiment of the R bridge/wire module mount assembly. A clearance channel 124 between the donor roll shaft and the R bridge is provided to enable free rotation of the donor roll. The R bridge 100 is mounted directly to the housing shelf 39, there being a gap in the bottom of the R bridge and wire module mount **104*b* forming legs 120. The housing wall fixed mount 122** can be configured so that the R bridge height may be adjusted if necessary relative to the donor roll and then fixed in place.

Figure 10:
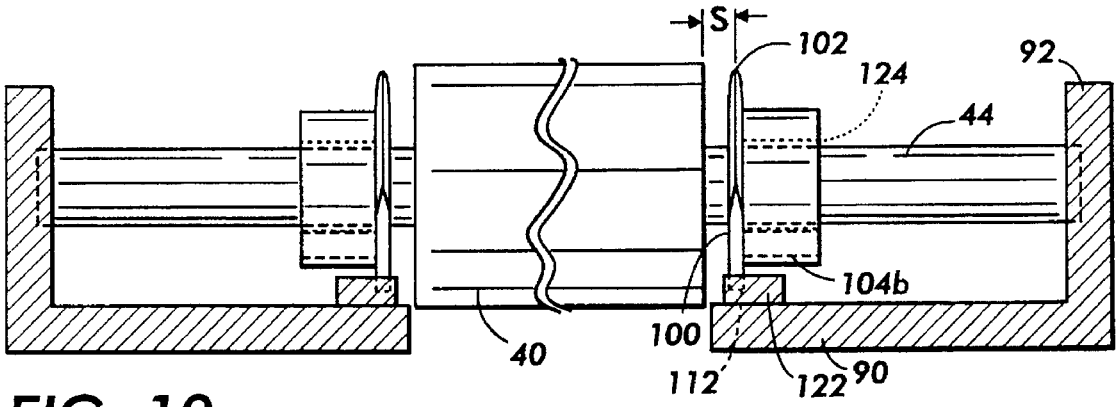
FIG. 10 is a side view of the wire support and wire module mount shown in FIG. 9.

FIG. 10 is a cross-sectional side view of the R bridge/wire module mount assembly of FIG. 9. The housing wall fixed mount 122 positively locates the R bridge bottom 112 so that the R bridge is fixed with respect to the housing wall.

As explained above, once the R bridge/wire module mount assembly is properly positioned with respect to the donor roll on the donor roll shaft, the wire module can be mounted to the wire module mount. The R bridge maintains the proper height and edge angle of the electrode wires relative to the donor roll edge and the wire module mount provides a stationary support for the wire module.

Figure 11:
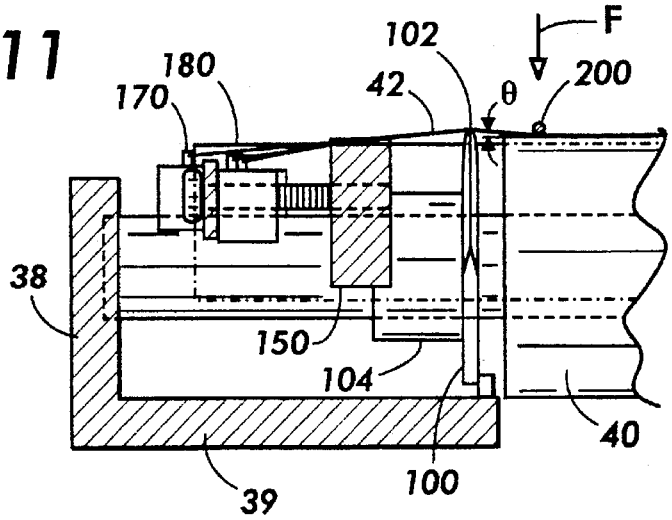
FIG. 11 is a side view of yet another embodiment of the wire support and wire module mount.

FIG. 11 shows another configuration of the wire module assembly in which the R bridge lifts the wires up and away from the ends of the donor roll. In this configuration, a positive wire edge angle (theta), as opposed to a negative wire edge angle that wraps around the donor edge roll, is formed. The positive edge angle results in less wear of the wires due to rubbing against the donor roll edge and also prevents printing defects caused by the rubbing of the rough donor edge on the wires. In order to maintain the critical electrode wire to donor roll relationship, a clamp 200 provides a downward force F as indicated by the arrow to the electrode wires near the end of the donor roll.

Figure 12:
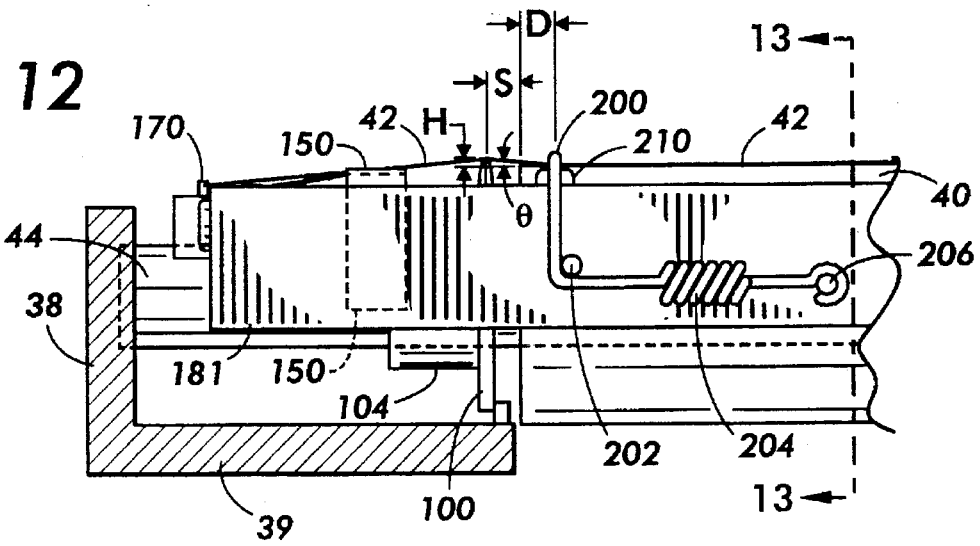
FIG. 12 is a similar view of the wire support and wire module mount of FIG. 11 with the clamp support added.

FIG. 12 is a side view of the configuration shown in FIG. 11, which includes the clamp support structure. The distance D from the clamp to the donor roll end is critical for proper performance. The clamp is located as close as possible to the end of the donor roll in order to maximize the effective area of the donor roll to the photoreceptor surface. It is located just outside of the width of the development area of the donor roll. The other positioning consideration is that of minimizing edge effects due to the rough edges of the donor roll. This is accomplished by locating the clamp a distance in from the edge of the donor roll so that the wires will not come into contact with the donor roll edge. The distance of the clamp from the donor roll end is preferably in the range between 1–10 mm.

Figure 13:
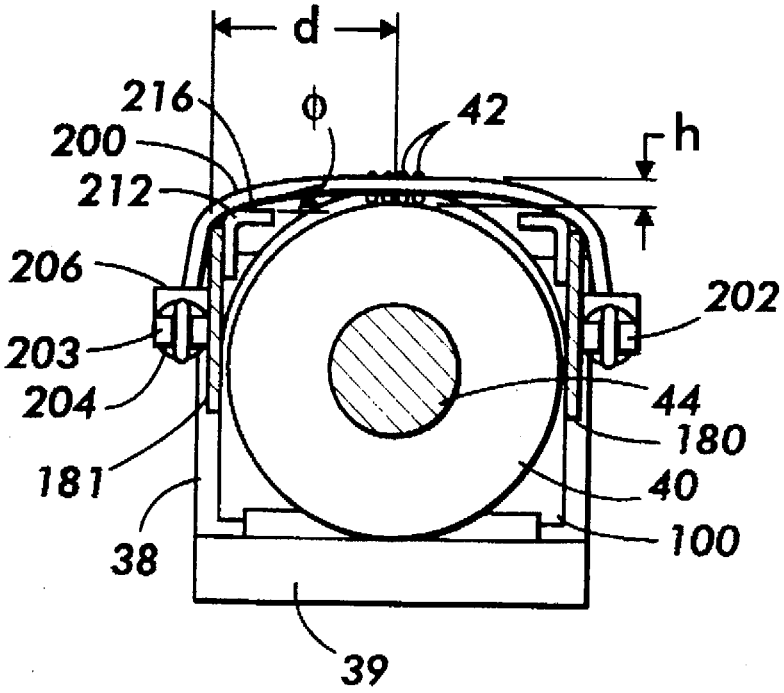
FIG. 13 is an end view of the wire support and wire module mount taken along line 13/13 of FIG. 12.

The clamp is supported on both sides of the donor roll by clamp support edges 212, shown in FIG. 13, which are attached to the side beams 180 and 181. The clamp support also provides electrical isolation of the clamp from the wire module side beams. The clamp support edge 212 could be as simple as a layer of suitable electrically insulating tape on the side beam. The clamp is located near the end of the donor roll by placing the clamp over the electrode wires mounting one end to a clamp locator 202 mounted on side beam 180. The other end of the wire is passed around another clamp locator 203 mounted on side meam 181 and attached to a spring 204, which is then mounted to mounting post 206. The clamp is then tensioned so that the proper downward force on the wires is obtained. The clamp locators 202 and 203 attached to the side of the side beams 180 and 181 can be in the form of a pin or any other fastening device. A tensioning mechanism 204, shown as a spring, aids in obtaining and maintaining the proper clamp tension.

The angle that the clamp makes with respect to the end of the donor roll, shown as theta, is important in the design of this configuration. The height of the R bridge relative to the donor roll H and the distance (D+S) of the clamp from the R bridge determine this angle.

The angle that the clamp makes with the top of the clamp support 216, shown as phi, is a factor in determining the amount of force to be applied by the clamp to the wires. This angle is related to the height h of the donor roll above the clamp support edge and the distance d of the support edge from the electrode wire 42. The net mechanical force, the combination of forces due to the clamping wire and R bridge and wire tension, is designed to be approximately zero under the clamp at the point between the electrode wire and the donor roll surface prior to operation. Once the developing system is operating, the electrostatic forces cause the electrode wires to be attracted to the donor roll surface, as in a development system without the clamp.

The clamping mechanism must electrically isolate the electrode wires 42 from the side beams side beams 180 and 181. This ensures that the clamp mechanism will not interfere with the development process. The diameter of the clamp must be small due to the space constraints of the development nip, the wire diameter being generally 25 to 125 microns. The clamp may be a metal wire, a metal wire with a plastic coating or a plastic thread. Any of which have sufficient tensile strength to maintain the desired tension without stretching. If a metal wire is used, an insulative material must be inserted between the clamp and the electrode wires, side beam and clamp support to insure electrical isolation of the clamp.

It is, therefore, apparent that there has been provided in accordance with the present invention, a scavengeless development wire support system that fully satisfies the aims and advantages herein before set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing a latent image recorded on a surface, including:

a housing defining a chamber storing a supply of developer material therein;

a donor roll spaced from the surface and adapted to transport the developer material to a development zone adjacent the surface;

a donor roll shaft on which said donor roll is mounted;

a donor roll support, said donor roll shaft being rotatably mounted in said donor roll support;

an electrode wire positioned in the space between the surface and said donor roll, said electrode wire being electrically biased to detach the developer material from said donor roll to form a cloud of developer material in the space between said electrode wire and the surface with the developer material developing the latent image;

a wire module providing means for attaching the ends of the wire and tensioning the electrode wire; and means for supporting the electrode wire along the length of the wire, said supporting means being rotatably mounted with respect to the donor roll and located along the donor roll shaft between each end of the donor roll and the donor roll support and having a wire support surface which supports the wire in the vertical direction when the electrode wire is positioned in the space between the surface and said donor roll, wherein said support means bas two support legs separated by an open section, the open section allowing said support means to fit over the donor roll shaft, the two legs of the support means are attached to the housing.

2. The apparatus as claimed in claim 1, wherein said wire support surfaces are arcuate.

3. The apparatus as claimed in claim 2, wherein the top edge of said wire support surfaces is rounded.

4. The apparatus as claimed in claim 1, wherein said donor roll shaft passes through said support means.

5. The apparatus as claimed in claim 4, further comprising a bearing located between the support means and the donor roll shaft and the bottom of said support means contacts the housing which prevents rotation of said support means.

6. The apparatus as claimed in claim 4, further comprising a clearance channel between the support means and the donor roll shaft.

7. The apparatus as claimed in claim 1, wherein the wire support surface is located a first distance from the donor roll shaft and the donor roll surface is located a second distance from the donor roll shaft, the first distance being less than the second distance.

8. The apparatus as claimed in claim 1, wherein the wire support surface is located a first distance from the donor roll shaft and the donor roll surface is located a second distance from the donor roll shaft, the first and second distances are approximately the same.

9. The apparatus as claimed in claim 1, wherein the wire support surface is located a first distance from the donor roll shaft and the donor roll surface is located a second distance from the donor roll shaft, the first distance being greater than the second distance.

10. The apparatus as claimed in claim 1, further comprising means for clamping the electrode wire which exerts a force against the electrode wire so that the wire is forced towards the donor roll surface.

11. An apparatus for developing a latent image recorded on a surface, including:

a housing defining a chamber storing a supply of developer material therein;

a donor roll spaced from the surface and adapted to transport developer material to a development zone adjacent the surface, said donor roll is mounted on a donor roll shaft, said donor roll shaft being rotatably mounted in a donor roll support;

an electrode wire positioned in the space between the surface and said donor roll, said electrode wire being electrically biased to detach developer material from said donor roll to form a cloud of developer material in the space between said electrode wire and the surface with the developer material developing the latent image;

a wire module having a frame to which the electrode wire ends are attached;

a wire module mount positioned along the donor roll shaft, the wire module being mounted to the wire module mount, and the wire module allowing the wires to be tensioned prior to mounting to the wire module mount;

an electrode wire support positioned along the donor roll shaft between each end of the donor roll end and the donor roll support which sets the edge angle of the electrode wire to the donor roll surface; and means for clamping the electrode wires which exerts a force against the electrode wires so that the wires are pushed towards the donor roll surface in the space between the surface and said donor roll.

12. An apparatus for developing a latent image recorded on a surface, including:

a housing defining a chamber storing a supply of developer material therein;

a donor roll spaced from the surface and adapted to transport the developer material to a development zone adjacent the surface;

a donor roll shaft on which said donor roll is mounted;

a donor roll support, said donor roll shaft being rotatably mounted in said donor roll support;

an electrode wire positioned in the space between the surface and said donor roll, said electrode wire being electrically biased to detach the developer material from said donor roll to form a cloud of developer material in the space between said electrode wire and the surface with the developer material developing the latent image;

a wire module providing means for attaching the ends of the wire and tensioning the electrode wire;

a wire module mount, said wire module mount being attached to said support means and the wire module is mounted on the wire module mount and is angularly adjustable with respect to the support means; and means for supporting the electrode wire along the length of the wire, said supporting means being rotatably mounted with respect to the donor roll and located along the donor roll shaft between each end of the donor roll and the donor roll support and having a wire support surface which supports the wire in the vertical direction when the electrode wire is positioned in the space between the surface and said donor roll.

13. The apparatus as claimed in claim 12, wherein said wire module is mounted to the wire module mount by a snap mount.

14. An apparatus for developing a latent image recorded on a surface, including:

a housing defining a chamber storing a supply of developer material therein;

a donor roll spaced from the surface and adapted to transport the developer material to a development zone adjacent the surface;

a donor roll shaft on which said donor roll is mounted;

a donor roll support, said donor roll shaft being rotatably mounted in said donor roll support;

an electrode wire positioned in the space between the surface and said donor roll, said electrode wire being electrically biased to detach the developer material from said donor roll to form a cloud of developer material in the space between said electrode wire and the surface with the developer material developing the latent image;

a wire module providing means for attaching the ends of the wire and tensioning the electrode wire;

means for supporting the electrode wire along the length of the wire, said supporting means being rotatably mounted with respect to the donor roll and located along the donor roll shaft between each end of the donor roll and the donor roll support and having a wire support surface which supports the wire in the vertical direction when the electrode wire is positioned in the space between the surface and said donor roll, wherein the wire support surface is located a first distance from the donor roll shaft and the donor roll surface is located a second distance from the donor roll shaft, the first distance being greater than the second distance; and means for clamping the electrode wire which exerts a force against the electrode wire so that the wire is forced towards the donor roll surface.

15. The apparatus as claimed in 14, wherein said clamping means is located near each end of the donor roll and within a region of the donor roll to minimize effects due to edge wear.

16. The apparatus as claimed in claim 14, wherein the net mechanical force under the clamping means at a point between the electrode wire and the donor roll surface is designed to be approximately zero.

* * * * *